US009234348B1

(12) United States Patent
Lehane et al.

(10) Patent No.: US 9,234,348 B1
(45) Date of Patent: Jan. 12, 2016

(54) DRYWALL TO ACOUSTICAL CEILING TRANSITION TRIMS

(71) Applicant: USG Interiors, LLC, Chicago, IL (US)

(72) Inventors: James J. Lehane, McHenry, IL (US); Peder J. Gulbrandsen, Aurora, IL (US); Chris C. Baker, North Aurora, IL (US)

(73) Assignee: USG INTERIORS, LLC, Chicago, IL (US)

( * ) Notice: Subject to any disclaimer, the term of this patent is extended or adjusted under 35 U.S.C. 154(b) by 0 days.

(21) Appl. No.: 14/468,388

(22) Filed: Aug. 26, 2014

(51) Int. Cl.

| | |
|---|---|
| ***E04B 2/00*** | (2006.01) |
| ***E04B 9/24*** | (2006.01) |
| ***B21B 15/00*** | (2006.01) |
| ***E04B 9/00*** | (2006.01) |
| ***E04B 9/18*** | (2006.01) |
| ***E04B 9/28*** | (2006.01) |
| *E04B 9/06* | (2006.01) |

(52) U.S. Cl.
CPC ..... *E04B 9/245* (2013.01); *B21B 15/0007* (2013.01); *E04B 9/008* (2013.01); *E04B 9/18* (2013.01); *E04B 9/28* (2013.01); *E04B 9/067* (2013.01); *E04B 9/068* (2013.01)

(58) Field of Classification Search
CPC ..... E04B 9/068; E04B 9/067; E04B 9/245; E04B 9/008; E04B 9/18; E04B 9/28; B21D 26/035; B26F 1/22; E04C 3/07; E04C 3/32; B21B 15/0007
USPC ..... 52/506.06, 506.07
See application file for complete search history.

(56) References Cited

U.S. PATENT DOCUMENTS

| | | | | |
|---|---|---|---|---|
| 2,931,470 | A * | 4/1960 | Brown | 52/364 |
| RE31,201 | E * | 4/1983 | Sauer | 52/667 |
| 4,520,609 | A * | 6/1985 | Worley et al. | 52/506.07 |
| 4,525,973 | A * | 7/1985 | Vukmanic et al. | 52/667 |
| 5,582,246 | A * | 12/1996 | Dinh | 165/181 |
| 6,167,601 | B1 * | 1/2001 | Gollhofer et al. | 29/6.1 |
| 6,305,201 | B1 * | 10/2001 | Ghiran et al. | 72/55 |
| 2008/0148668 | A1 * | 6/2008 | Jahn et al. | 52/506.07 |
| 2010/0326006 | A1 * | 12/2010 | Yaros | 52/711 |

OTHER PUBLICATIONS

"Transition Molding Acoustical to Drywall Transition Molding" brochure, 4 pgs., Copyright 2012 AWI Licensing Company.

* cited by examiner

*Primary Examiner* — Basil Katcheves
*Assistant Examiner* — Joshua Ihezie
(74) *Attorney, Agent, or Firm* — Pearne & Gordon LLP

(57) ABSTRACT

An elongate roll formed sheet metal molding, and method of its manufacture, for transitioning between a drywall ceiling and an acoustical tile ceiling, the molding have the general shape of an inverted tee formed by a horizontal drywall leg, a horizontal acoustical tile leg and a vertical leg between the horizontal legs, the drywall leg having a plurality of regularly spaced holes for receiving fasteners to attach the molding to a ceiling structure, a periphery of each hole being partially lanced in the sheet metal such that material from the hole forms a slug, the slug remaining attached to the sheet metal at a part of the hole, the slug being bent flat onto an area of the sheet metal adjacent the hole.

6 Claims, 5 Drawing Sheets

DRYWALL TO ACOUSTICAL CEILING TRANSITION TRIMS

BACKGROUND OF THE INVENTION

The invention relates to metal molding useful in interior building construction.

PRIOR ART

A class of metal moldings exists for ceiling construction with joints between suspended acoustical panels or tiles and drywall. These moldings, sometimes called transition moldings, are typically made of sheet metal roll formed into a desired shape. Various cross-sectional designs, generally of an inverted tee shape, have been available to provide a desired appearance. A shadow or slot division between the drywall and acoustical panels is a common style for such molding.

The drywall side of the molding is ordinarily provided with regularly spaced holes for accepting drywall screws used to fasten the molding to a support behind the drywall and with a knurled surface to provide adhesion of joint compound used to conceal the associated part of the molding. It is also known to perforate one layer of a double layer stem or leg of the molding along its length in a regular pattern to receive and guide the point of a mounting screw as such screw is driven through the non-perforated layer of the vertical leg into adjacent support structure.

There is a need for reducing the manufacturing costs of transition molding as well as for improving the ease of installation of such molding.

SUMMARY OF THE INVENTION

The invention provides a metal transition molding that can reduce manufacturing costs, provide greater screw pull out strength and improve torsional stiffness.

One aspect of the invention involves novel screw receiving holes on the drywall side or leg of the transition molding. The disclosed holes are formed in a rotary lancing mechanism. Metal strip material removed from a hole area in the lancing operation remains attached to the strip as a slug. Each slug is folded back on the strip adjacent the hole. Retention of the slug on the strip avoids machinery complications otherwise needed to reliably capture a fully severed slug thereby reducing tooling and maintenance costs of manufacture. The retained slug serves to increase the screw pull through strength of the strip at the lanced hole. The increased pull through force is obtained even while the hole is large enough to avoid or reduce interference with the threads of a screw being installed in the hole and to allow the screw to readily self-counter-sink its head in the molding strip. Preferably, the slug is folded onto the rear face of the molding leg that contacts the drywall and is partially driven into the plane of the sheet proper.

In accordance with another aspect of the invention, the molding is rotary center-punched in a roll set. Interlocking dimples are formed in both layers of a double layer vertical leg of the molding. The dimples are located to receive and center guide the lead ends of screws used to fasten the molding to adjacent ceiling structure. The dimples, additionally, fix the layers against relative motion in their respective planes, thereby improving the torsional strength and ease of handling.

DESCRIPTION OF THE PREFERRED EMBODIMENTS

Figure 1:
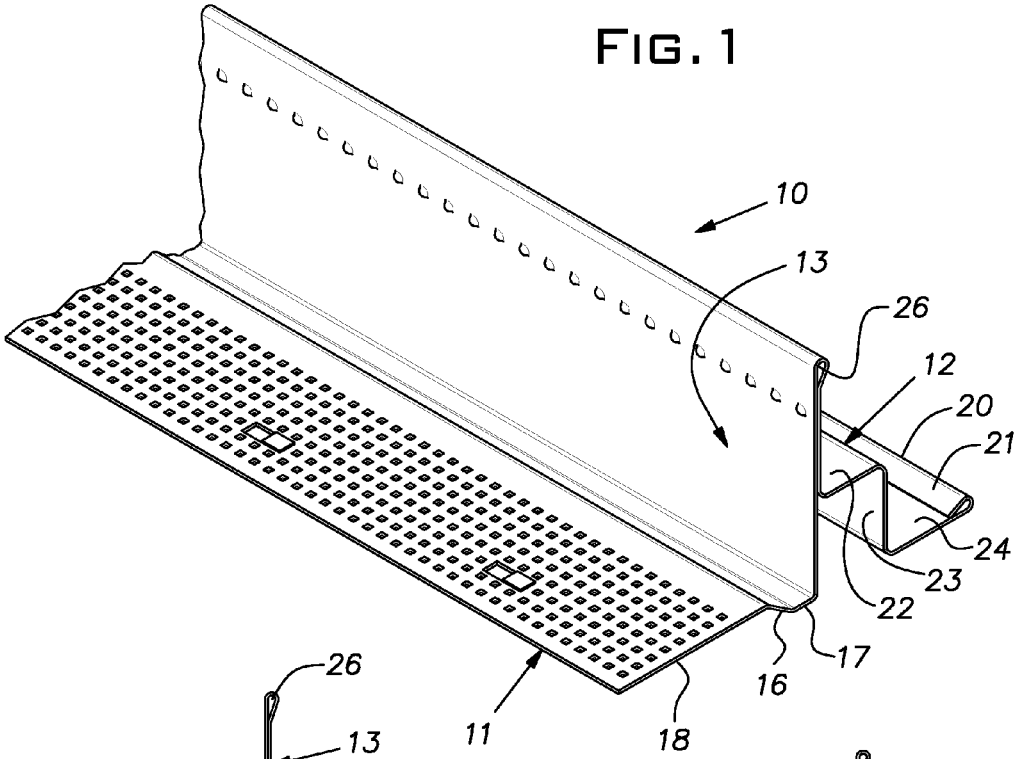
FIG. 1 is a fragmentary isometric view of one form of a transition molding constructed in accordance with the invention.
Figure 2:
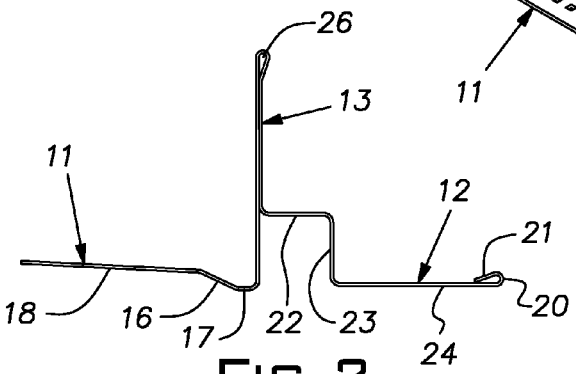
FIG. 2 is a cross-sectional view of the transition molding of FIG. 1.
Figure 8:
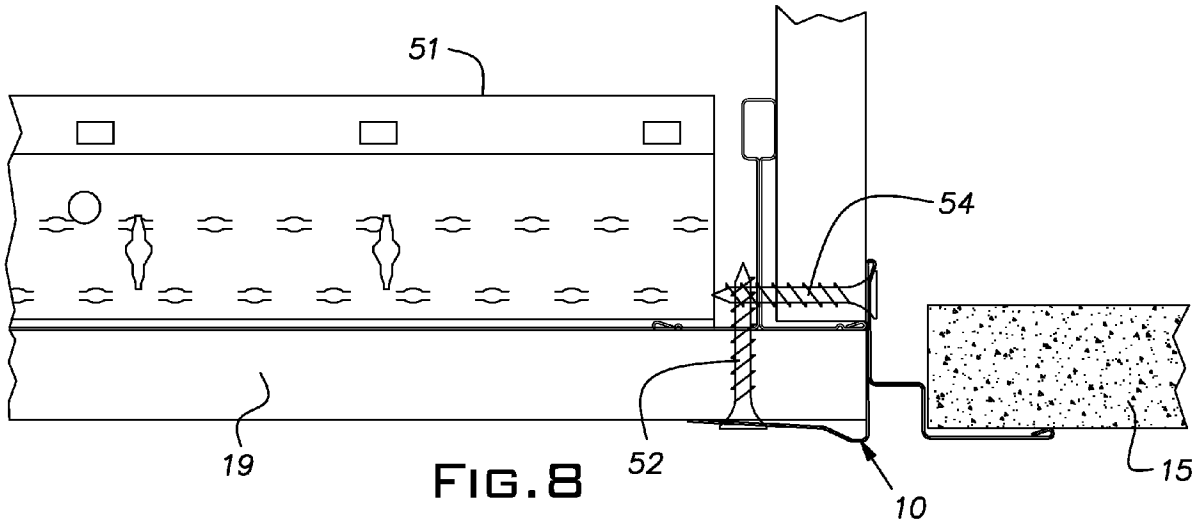
FIG. 8 is a fragmentary cross-sectional view of the transition molding installed on a drywall grid tee covered with drywall and supporting the edge of a ceiling panel.
Figure 9:
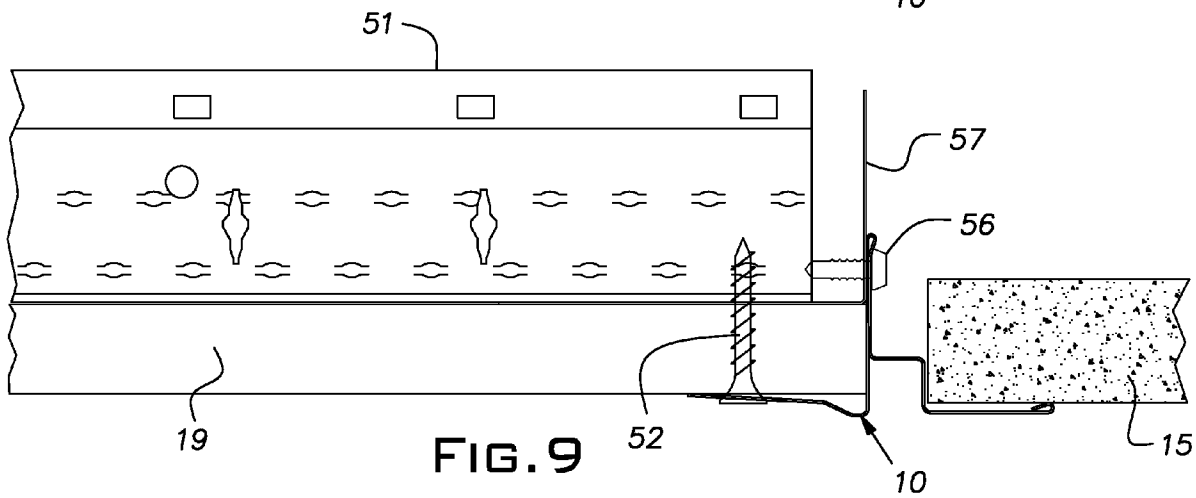
FIG. 9 is a view similar to FIG. 7 with the transition molding installed on a sheet metal support.

FIGS. 1 and 2 illustrate an example of a "shadow" style transition molding 10. The molding 10 is a one piece roll formed sheet metal product, made of 0.018 gauge pre-painted steel, for example. The molding is supplied in 10 foot lengths or industry metric equivalent. The molding 10 has the general shape of an inverted tee with two horizontal legs 11, 12 and a vertical division leg 13 disposed between the horizontal legs. FIGS. 8 and 9 illustrate the leg 11 on the left associated with ceiling drywall 19 and the leg 12 on the right associated with acoustical tile or panels 15. The drywall leg 11 has an offset or rise 16 between a minor area 17 adjacent the vertical leg 13 and a larger area 18 distal from the vertical leg. The offset 16 enables the larger area 18 to be concealed and visually blended in with a sheet of drywall 19 by taping and coating the large area with joint compound. As is known in the art, a lower face of the area 18 can be knurled.

A distal edge 20 of the acoustical panel leg 12 has a downturned hem 21 that contributes to the stiffness and straightness of the leg. An inner part of the leg 12 adjacent the vertical leg 13 is formed with horizontal and vertical sections 22, 23 respectively to produce a "shadow" effect. An outboard or distal part 24 of the leg 12 is generally coplanar with the proximal area 17 of the drywall leg 11. In a completed ceiling installation, the outboard section 24 supports the edge of overlying acoustical tile 15 as depicted in FIGS. 8 and 9.

The vertical leg 13 is a double layer of the molding strip. At an upper end, the strip material is folded on itself while leaving a small hollow 26 that serves to stiffen the molding 10.

Figure 6:
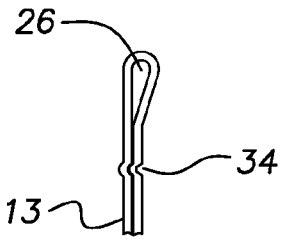
FIG. 6 is a fragmentary cross-sectional view on an enlarged scale taken in the plane 6-6 in FIG. 5 of a distal or upper end of a central double layer leg of the transition molding.
Figure 11:
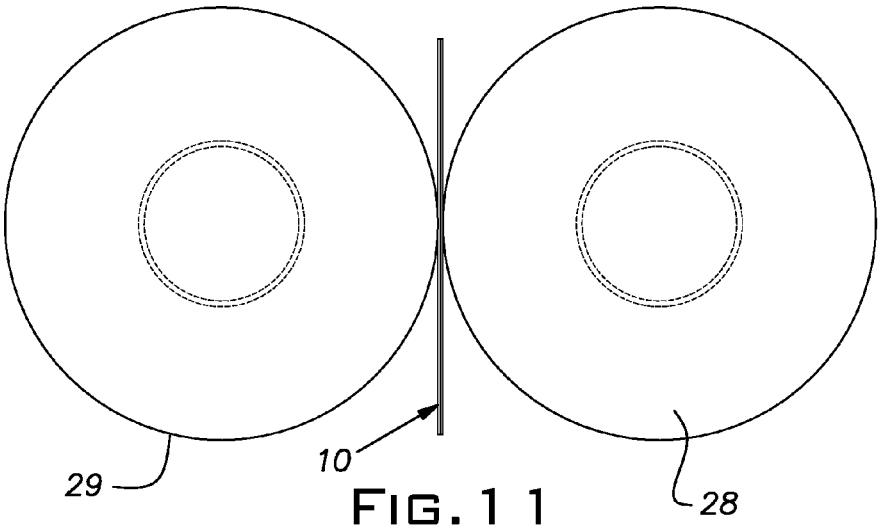
FIG. 11 is a diagrammatic plan view of the station of FIG. 10.
Figure 10:
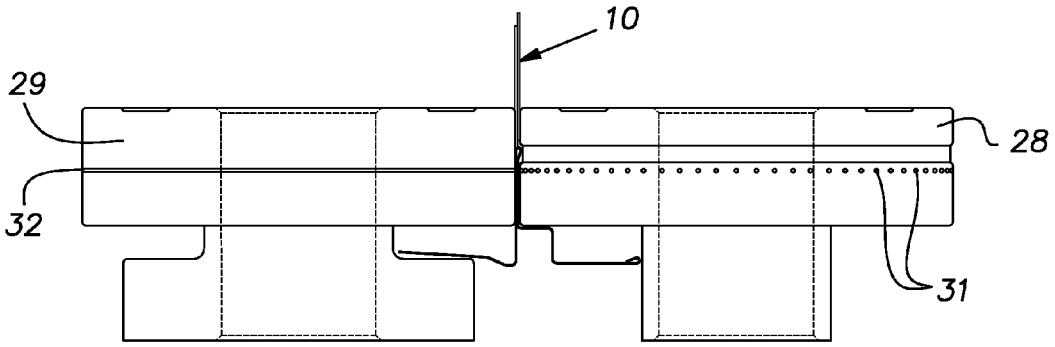
FIG. 10 is a diagrammatic elevational view of a roll station at which center punch dimples are formed in the vertical molding leg in a roll forming line.

FIGS. 10 and 11 schematically represent a late station in a roll forming line in which the molding 10 is produced. The molding stock with its finished cross-sectional profile is passed between a pair of rolls 28, 29 comprising a rotary punch and die set. The punch roll 28 has a series of small, evenly spaced projections or punches on its periphery and the die roll 29 has a peripheral groove 32 aligned with the projections 31. The rolls 28, 29 with their peripheries moving at line speed of the roll forming equipment cooperate to form a series of center punches or indentations 34 on a side of the leg 13 facing away from the drywall leg 11. FIG. 6 shows that the center punches 34 are each formed in both layers of the vertical leg 13. The center punches 34 are spaced below the upper edge of the vertical leg and serve to lock the individual layers of the leg 13 together against shear, thereby stiffening the molding, particularly in torsion about its length.

Figure 7:
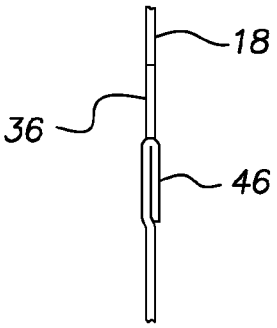
FIG. 7 is a fragmentary cross-sectional view on an enlarged scale taken in the plane 7-7 in FIG. 5 of a lanced hole in the drywall contacting leg of the transition molding.
Figure 12:
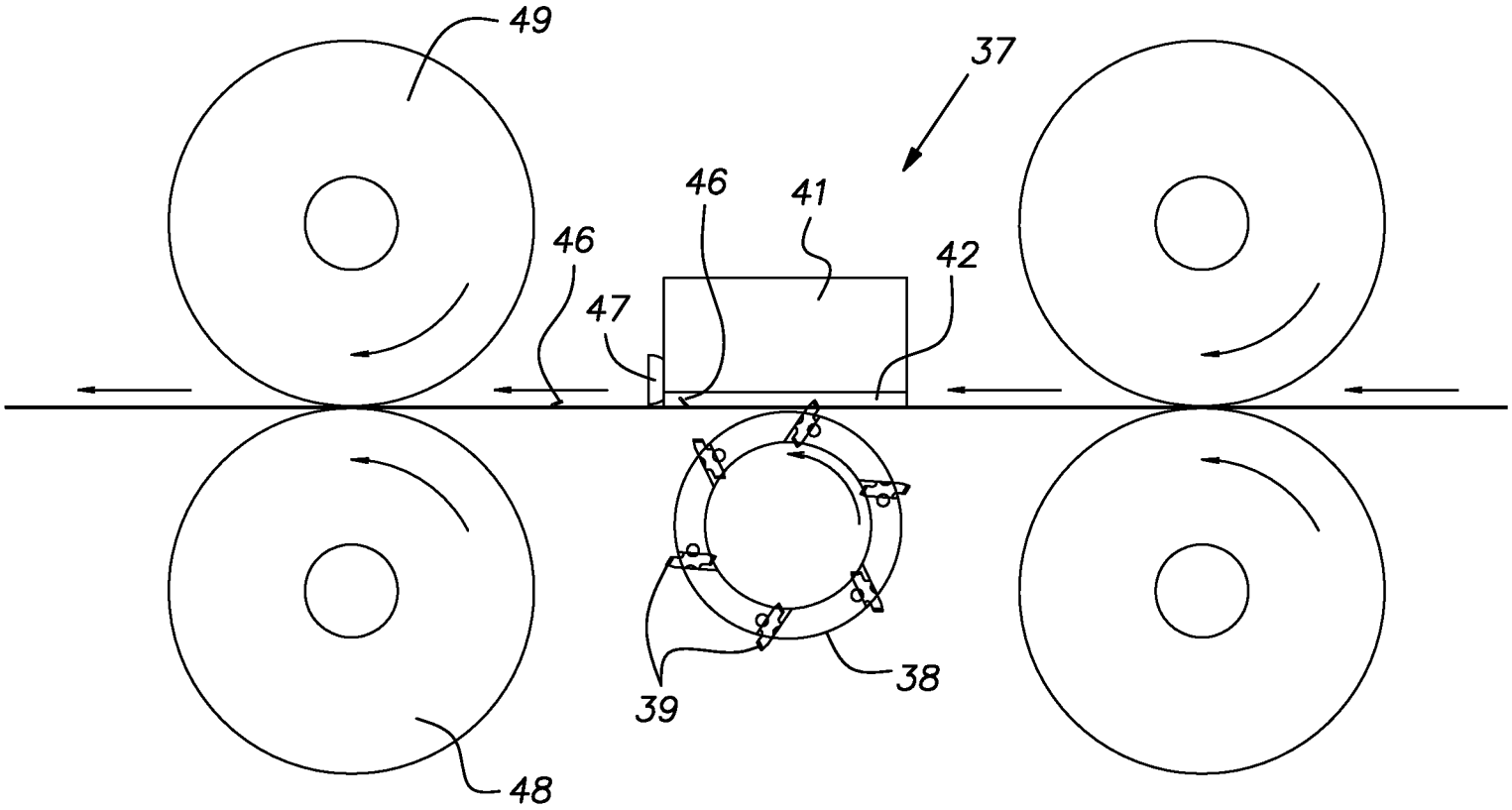
FIG. 12 is a diagrammatic elevational view of a rotary lance station and a slug flattening station in a roll forming line.

The drywall leg 11 is produced with regularly spaced holes 36 for receiving screws or, less commonly, nails that attach the molding 10 to a ceiling structure. The holes 36 are formed at a rotary lance station 37 illustrated in FIG. 12. The station 37 has a roll 38 carrying a plurality of lance punches 39 that project from the roll periphery. The lance punches 39 pierce the drywall leg 11 as the molding stock strip passes through the station 37. A die block 41 on a side of the molding strip stock opposite the punch roll 38 has a close fitting slot 42 that receives the lance punches 39 as they pierce the drywall leg material. The lance punches 39 cut three sides of a square hole 36 leaving a slug 46 from the hole area attached to the remaining side of the hole. As the strip moves along the rolling path, the slug 46 is bent back over the side of the hole at which it is attached by a wipe block 47 at the exit of the lance station 37. A set of rollers 48, 49 in the roll forming machine form a nip with shallow grooves in alignment with the slug 46. The rollers 48, 49 force the slug 46 into the plane of the material of the leg 11 as shown in FIG. 7. By leaving the slug 46 attached to the molding stock, the machinery is greatly simplified and machine maintenance is reduced by avoiding the need to collect free slugs which can otherwise jam the equipment and/or result in product defects.

FIG. 8 illustrates the molding 10 installed by anchoring it to a drywall grid tee or runner 51. A drywall screw 52 located in a hole 36 is driven vertically through a sheet of drywall 19 and into a flange of the grid tee 51. The holes 36 can be 0.16 inch square, for example, so that they are larger than the thread crest of a No. 6 drywall screw. Consequently, there is no interference with the screw threads and the hole 36 that would cause local buckling of the molding sheet stock at the hole.

Ideally, the head of the screw 52 is at least partially countersunk as the perimeter of the hole 36 is drawn inwardly by the screw head. With the screw head at least partially countersunk, there is no interference with a taping knife or trowel used to cover the face of the area 18 of the horizontal leg 11. The presence of the slug 46 at the hole 36 increases the ability of the molding 10 to resist pull through of the screw head so that an installer can quickly set the screw 52 with less concern about over-tightening it such that the head would completely pull through the hole.

FIG. 8 illustrates the molding 10 additionally attached to the grid tee 51 by a second drywall screw 54 driven through the vertical leg 13 at a center punch 34 into the drywall grid tee web. FIG. 9 illustrates the molding 10 attached with a self-drilling sheet metal screw 56 driven through the vertical leg 13 at a center punch 34 into a sheet metal framing member such as a sheet metal angle 57.

Figure 4:
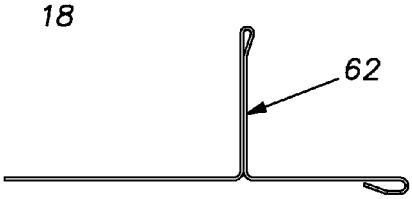
FIG. 4 is a cross-sectional form of a third form of a transition molding of the invention.
Figure 3:
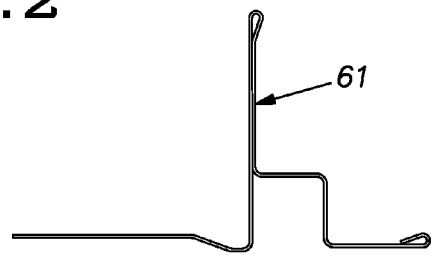
FIG. 3 is a cross-sectional view of a second form of a transition molding of the invention.
Figure 5:
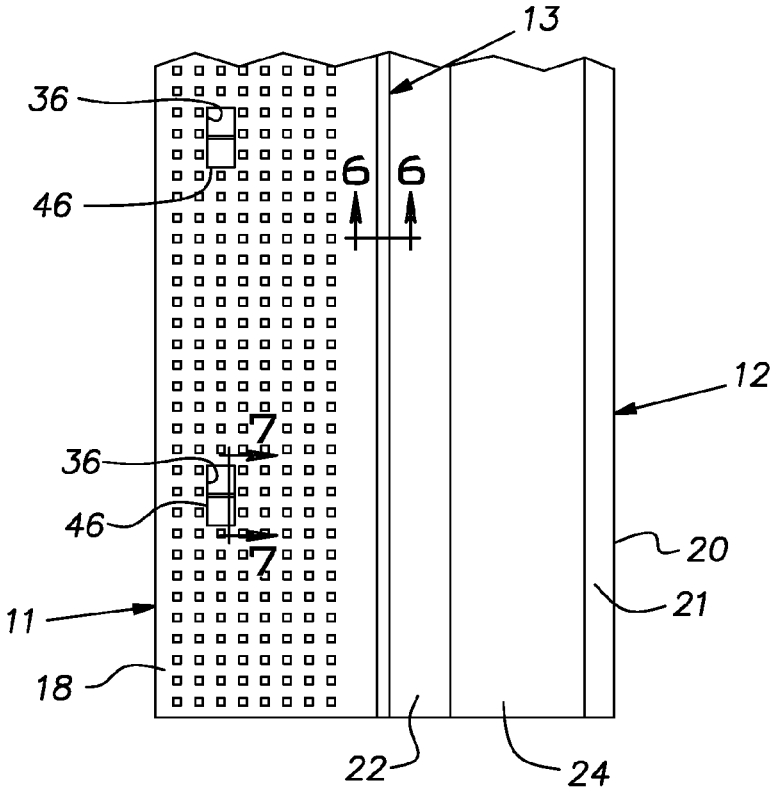
FIG. 5 is a fragmentary plan view of the molding of FIGS. 1 and 2.

FIGS. 3 and 4 illustrate alternative transition moldings 61, 62 used to practice the invention. The molding 61 of FIG. 3 can be used with narrow faced ceiling grid and the molding 62 of FIG. 4 can be used where a "shadow" look is not specified.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An elongate roll formed sheet metal molding for transitioning between a drywall ceiling and an acoustical tile ceiling, the molding have the general shape of an inverted tee formed by a horizontal drywall leg, a horizontal acoustical tile leg and a vertical leg between the horizontal legs, the drywall leg having a plurality of regularly spaced holes for receiving fasteners to attach the molding to a ceiling structure, a periphery of each hole being partially lanced in the sheet metal such that material from the hole forms a slug, the slug remaining attached to the sheet metal at a part of the hole, the slug being bent flat onto an area of the sheet metal adjacent the hole, the hole and slug being rectangular and a side of the slug being attached to a side of the hole, and, wherein the slug resides in the plane of the horizontal drywall leg.

2. A molding as set forth in claim 1, wherein the slug is on a side of the drywall leg that when the molding is installed on a sheet of drywall is in contact with the drywall sheet.

3. A molding as set forth in claim 1, wherein the vertical leg is a double layer of metal sheet stock.

4. A molding as set forth in claim 3, wherein the vertical leg is permanently deformed to provide a circular center punch at successive locations along the length of the molding on a side facing away from the drywall leg, the center punch deformation having a major diameter less than the thickness of the vertical leg whereby the center punch is adapted to center an attaching screw.

5. A molding as set forth in claim 4, wherein the center punch deformation exists in both vertical leg layers whereby the layers are mechanically interlocked against relative shear movement in a plane parallel to said layers.

6. A molding as set forth in claim 5, wherein an upper end of the vertical leg has a hollow formed by an open bend between said layers.

* * * * *